United States Patent [19]

Tsuchiya et al.

[11] 4,228,429

[45] Oct. 14, 1980

[54] ALARM SYSTEM HAVING PHASE-SENSITIVE BRIDGE CIRCUIT

[75] Inventors: Keishin Tsuchiya, Higashi-Yamato; Ichiro Yoshihara, Funabashi; Kazuhito Saito, Kawasaki; Takeshi Abe; Kiyoshi Abe, both of Yokohama; Kiyoshi Sone, Tokyo, all of Japan

[73] Assignee: Ricoh Company, Ltd., Tokyo, Japan

[21] Appl. No.: 968,469

[22] Filed: Dec. 11, 1978

[30] Foreign Application Priority Data

| | | | |
|---|---|---|---|
| Dec. 29, 1977 | [JP] | Japan | 52/159460 |
| Dec. 29, 1977 | [JP] | Japan | 52/159461 |
| Dec. 29, 1977 | [JP] | Japan | 52/159462 |

[51] Int. Cl.[2] ..... G08B 17/10

[52] U.S. Cl. ..... 340/632; 340/658; 340/661; 422/96

[58] Field of Search ..... 340/602, 604, 632, 633, 340/634, 661, 658; 73/23, 27 R; 422/94, 95, 96, 97

[56] References Cited

U.S. PATENT DOCUMENTS

| | | | |
|---|---|---|---|
| 3,221,320 | 11/1965 | Yoneda | 340/633 |
| 3,950,740 | 4/1976 | Greene | 340/602 X |
| 3,961,900 | 6/1976 | Gintelia | 340/632 X |
| 3,997,837 | 12/1976 | Betz et al. | 340/634 X |
| 4,084,156 | 4/1978 | Wittlinger | 340/661 X |
| 4,146,887 | 3/1979 | Magnante | 340/633 X |

*Primary Examiner*—John W. Caldwell, Sr.
*Assistant Examiner*—Daniel Myer
*Attorney, Agent, or Firm*—Burgess, Ryan and Wayne

[57] ABSTRACT

An alarm system for detecting a dangerous condition such as the increase in content of or the presence of toxic or inflammable gas in the air and giving a warning signal. The alarm system comprises an AC power supply, a full-wave rectifier connected to the AC power supply and rectifying alternating current from the AC power source into direct current. An AC bridge circuit connected to the AC power supply and includes a sensor element at least in one branch. An AC operational amplifier is supplied with power from the full-wave rectifier and receives an input signal which is the output signal delivered from the bridge circuit through a DC blocking capacitor. A thyristor is connected in parallel with the AC power supply, with its control gate connected to the output of the operational amplifier, and its main electrodes in series with an alarm indicator actuable when the thyristor is triggered into the conduction state. Such triggering occurs when the output signal voltage from the operational amplifier reverses its phase by 180°, i.e., when the resistance of the sensor element varies when a dangerous condition exists.

4 Claims, 5 Drawing Figures

ALARM SYSTEM HAVING PHASE-SENSITIVE BRIDGE CIRCUIT

BACKGROUND OF THE INVENTION

The present invention relates to an alarm system for detecting a dangerous or abnormal condition such as gas leakage and giving a warning signal.

A wide variety of the alarm systems of the type described have been devised and demonstrated, but all of them utilize DC amplifiers, so that a relatively long time is required for the offset adjustment in the production line. Furthermore, the misadjustments result in the erroneous operation of the alarm systems; that is, the variations in the contents level at which the alarm systems must be actuated. As a result, the alarm system fails to operate even when the contents of gas rises above a dangerous level. Moreover, the variable resistors used for the offset adjustments exhibit unsatisfactory aging characteristics, resistance to shock and gas and so on. One solution to this problem is the use of totally enclosed variable resistors, but the cost inevitably increases.

SUMMARY OF THE INVENTION

Accordingly, one of the objects of the present invention is to provide an alarm system which utilizes an AC amplifier, thereby eliminating the offset adjustment.

Another object of the present invention is to provide an alarm system which may eliminate the tedious and cumbersome offset adjustment so that no erroneous operation results due to the misadjustment.

A further object of the present invention is to provide an alarm system which may eliminate the use of the offset adjustment variable resistor so that various problems resulting from the unsatisfactory aging characteristic, and resistance to shock and gas thereof may be substantially overcome.

BRIEF DESCRIPTION OF THE DRAWINGS

Same reference numerals are used to designate similar parts throughout the figures.

DESCRIPTION OF THE PREFERRED EMBODIMENTS

Figure 1:
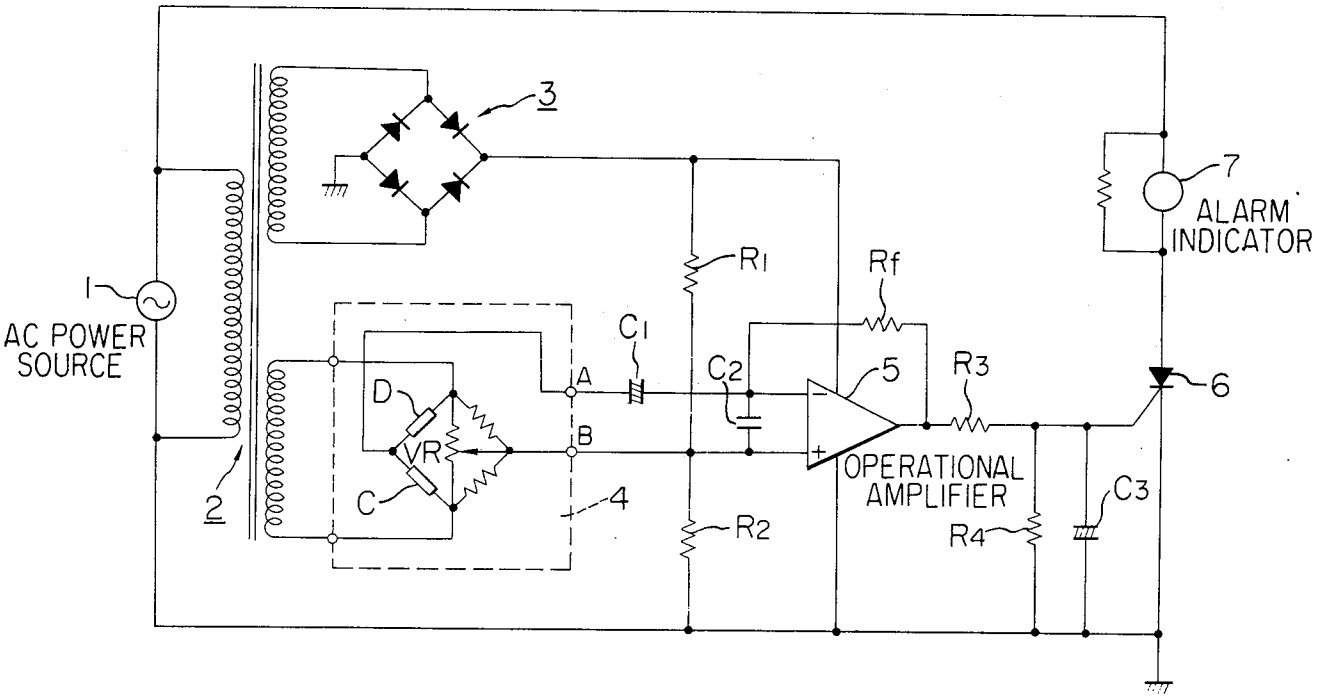
FIG. 1 is a circuit diagram of a first embodiment of an alarm system in accordance with the present invention.
Figure 2:
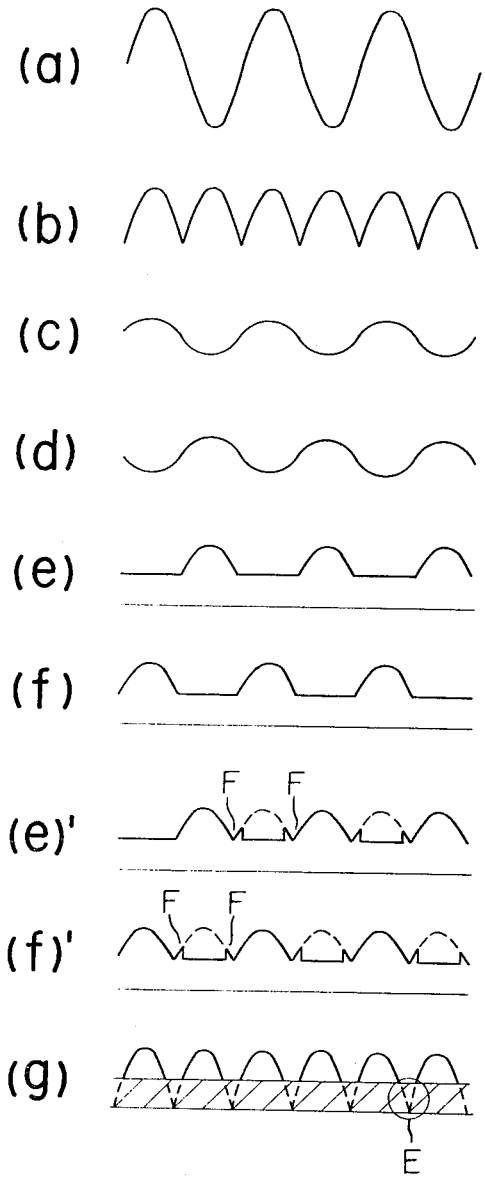
FIG. 2 shows waveforms of various electrical signals used for the explanation of the modes of operation of the preferred embodiments of the present invention.

Referring to FIGS. 1 and 2, the output voltage [See FIG. 2(*a*)] from an AC power source 1 is applied through an alarm indicator 7 such as a buzzer across the anode and cathode of a thyristor 6. This output voltage is also stepped down to desired voltages by a transformer 2 and applied to a full-wave rectifier 3 and an AC bridge circuit 4. The output voltage [See FIG. 2(*b*)] of the full-wave rectifier 3 is supplied to an operational amplifier 5 not only as a power supply voltage but also as an input signal to the noninverting terminal (+) after it is stepped down to a desired level by a voltage divider consisting of resistors $R_1$ and $R_2$.

One branch of the AC bridge circuit 4 consists of a gas sensor D whose electrical resistance varies when the gas sensor D is exposed to a toxic or an inflammable gas, and another branch consists of a temperature-compensating element C for compensating the temperature variation of the resistance of the gas sensor D.

Therefore, under the normal condition; that is, when no inflammable gas is present in the air, the AC bridge circuit 4 is unbalanced, but when the content of the inflammable gas to be detected in the air reaches a hazardous level, it is balanced so that its output voltage drops almost to zero and is inverted in phase by 180°.

The output signal derived from one output terminal A of the bridge circuit 4 is applied through a DC blocking capacitor $C_1$ to the inverting input (−) of the operational amplifier 5. The other output terminal B is connected to the junction between the voltage dividing resistors $R_1$ and $R_2$. As a result, the input signal to the noninverting input of the operational amplifier 5 rises above or drops below the reference voltage which is determined by the voltage divider consisting of the resistors $R_1$ and $R_2$.

Therefore, when the AC bridge circuit 4 is not balanced, the input signal as shown in FIG. 2(*c*) is applied to the operational amplifier 5 so that the output signal as shown in FIG. 2(*e*) is derived. When the AC bridge circuit 4 is balanced and then unbalanced in the inverted state, the output signal is inverted in phase by 180° as shown in FIG. 2(*d*) so that the operational amplifier 5 delivers the output signal as shown in FIG. 2(*f*). The output voltage of the operational amplifier 5 is divided by a voltage divider consisting of resistors $R_3$ and $R_4$ and applied to the gate of the thyristor 6.

Thus, under the normal condition, when the gate voltage is positive, the voltage applied across the anode and cathode of the thyristor 6 is reverse biased and remains in the OFF state. However, under the abnormal condition, when the gate voltage is positive the voltage applied across the anode and cathode of the thyristor 6 is forward biased and is triggered into conduction. As a result, the alarm indicator 7 is actuated. Capacitors $C_2$ and $C_3$ are inserted in order to remove noise.

Figure 3:
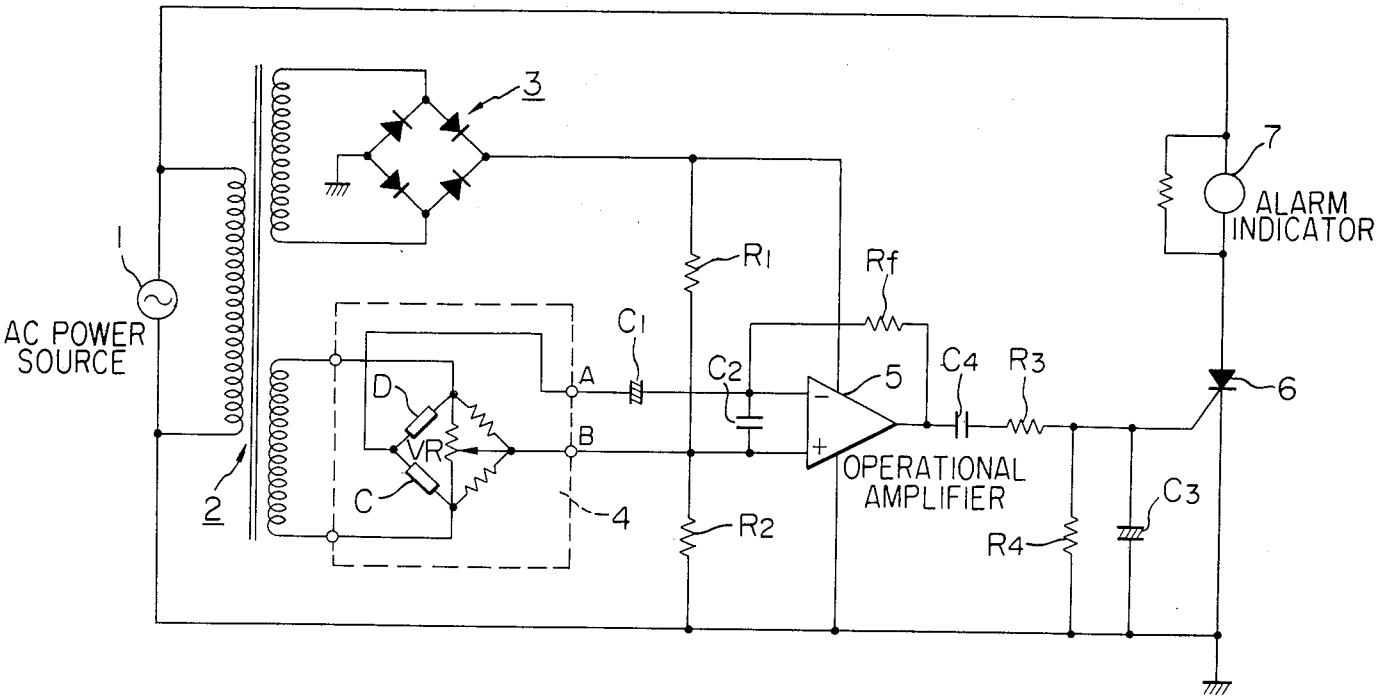
FIGS. 3, 4 and 5 are circuit diagrams of further embodiments, respectively, of the present invention.

FIG. 3 shows a circuit diagram of a second embodiment of the present invention which is substantially similar in construction to the first embodiment shown in FIG. 1 except that a differentiating capacitor $C_4$ is connected between the output of the operational amplifier 5 and one end of the resistor $R_3$ because of the reason to be described in detail below.

Referring back to FIG. 1, the operational amplifier 5 is supplied with the power voltage from the full-wave rectifier 3 so that the power supply voltage drops to zero momentarily as indicated by E in FIG. 2(*g*). That is, when the power supply voltage drops below a certain level (hatched area in FIG. 2(*g*), the operational amplifier 5 cannot operate correctly. As a result, spikes appear in the output of the operational amplifier 5 as indicated by F in FIGS. 2(*e*)′ and 2(*f*)′. The capacitor $C_4$ is inserted in order to remove these spikes. Furthermore, the insertion of this capacitor $C_4$ is advantageous in that the tolerance of the ratio between the values of the resistors $R_3$ and $R_4$ may be considerably relaxed and consequently the variations in their values due to manufacture tolerances may be tolerable in their effects upon the overall operation of the alarm system.

Figure 4:
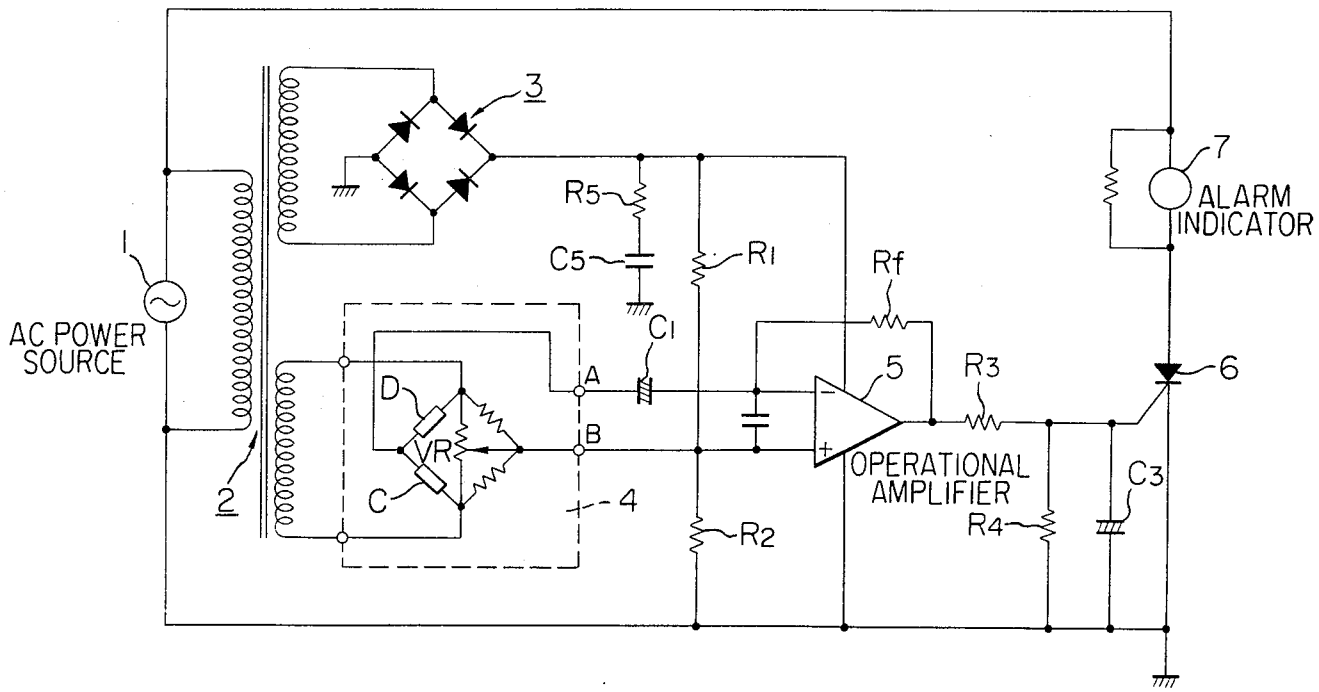

FIG. 4 shows a third embodiment of the present invention which is also substantially similar in construction to the first embodiment except that a series combination of a resistor $R_5$ and a smoothing capacitor $C_5$ is inserted between the output terminal of the full-wave rectifier 3 and the ground in order to remove the spikes F. Because of the insertion of the smoothing capacitor $C_5$, the output voltage of the full-wave rectifier 3 may be smoothed and the power supply voltage above a predetermined level may be always impressed to the operational amplifier 5 so that no dead band or zone results and consequently no spike appears.

Figure 5:
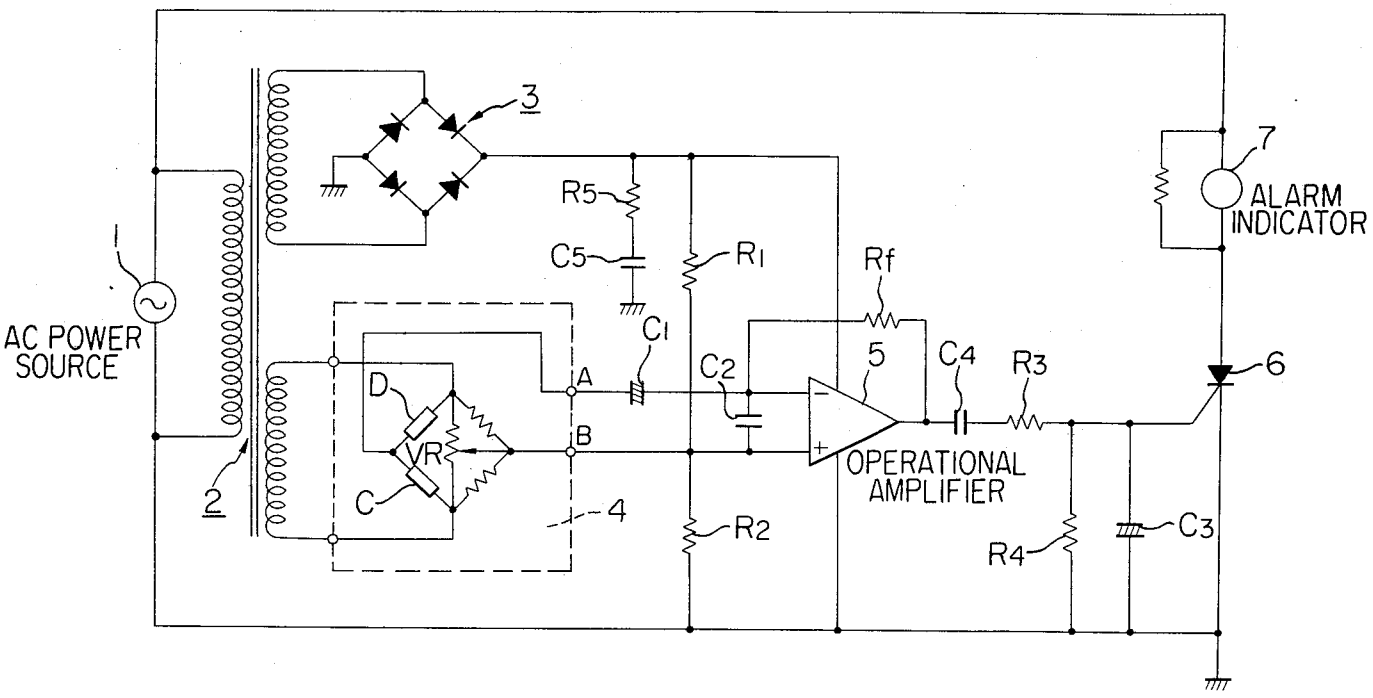

FIG. 5 shows a circuit diagram of a fourth embodiment which is substantially similar in construction to the third embodiment except that the capacitor $C_4$ is inserted as in the case of the second embodiment shown in FIG. 3. With this arrangement, the erroneous operation of the thyristor 6 due to the phase lag may be completely avoided. Furthermore, as with the third embodiment, the tolerance of the ratio between the values of the resistors $R_3$ and $R_4$ may be considerably relaxed and consequently the variations in their values due to manufacture tolerances may be tolerable in their effects on the overall operation of the alarm system.

What is claimed is:

1. An alarm system comprising (a) an AC power supply circuit, (b) a full-wave rectifier for effecting full-wave rectification of the alternating current supplied from said AC power supply circuit, (c) an AC bridge circuit which is supplied with the power from said AC power supply circuit and which includes a sensor element in at least one branch of the bridge thereof, (d) a DC blocking capacitor having one terminal connected to an output terminal of said bridge circuit, (e) an operational amplifier which is supplied with power from said full-wave rectifier and receives the output signal from said AC bridge circuit through said DC blocking capacitor, an input terminal of said amplifier being connected to the other terminal of said blocking capacitor, (f) a thyristor having main electrodes connected to said AC power supply circuit and a control electrode for receiving the output signal from said operational amplifier, and (g) an alarm indicator coupled to at least one of said main electrodes of said thyristor and actuable when said thyristor is triggered into the conduction state by said operational amplifier output signal when the phase of the AC output signal from said AC bridge circuit is reversed by 180° due to the variation in resistance of said sensor element under abnormal conditions.

2. An alarm system as set forth in claim 1 wherein a differentiating capacitor is connected to the output of said operational amplifier.

3. An alarm system as set forth in claim 1 wherein a smoothing circuit is connected to the output of said full-wave rectifier.

4. An alarm system as set forth in claim 1 wherein a differentiating capacitor is connected to the output of said operational amplifier; and a smoothing circuit is connected to the output of said full-wave rectifier.

* * * * *